United States Patent [19]

Kuhfuss, Jr.

[11] 4,262,550

[45] Apr. 21, 1981

[54] GOVERNOR AND DECELERATOR CONTROL LINKAGE

[75] Inventor: Alvin L. Kuhfuss, Jr., Morton, Ill.

[73] Assignee: Caterpillar Tractor Co., Peoria, Ill.

[21] Appl. No.: 166,501

[22] Filed: Jul. 7, 1980

Related U.S. Application Data

[63] Continuation-in-part of Ser. No. 30,245, Feb. 12, 1979, abandoned.

[51] Int. Cl.[3] ..... G05G 11/00; G05G 5/04

[52] U.S. Cl. ..... 74/482; 74/479; 74/526; 192/8 R

[58] Field of Search ..... 74/479, 480 R, 481, 74/482, 526; 192/8 R

[56] References Cited

U.S. PATENT DOCUMENTS

| | | | |
|---|---|---|---|
| 3,125,897 | 3/1964 | Zeman | 74/526 X |
| 3,508,454 | 4/1970 | Fanslow et al. | 74/482 |
| 3,535,951 | 10/1970 | Larson et al. | 74/482 |
| 4,052,910 | 10/1977 | Olt, Jr. et al. | 74/482 |
| 4,059,025 | 11/1977 | Waack et al. | 74/482 |

*Primary Examiner*—Allan D. Herrmann

*Attorney, Agent, or Firm*—Wegner, Stellman, McCord, Wood & Dalton

[57] ABSTRACT

A governor and decelerator control linkage has two shafts (16 and 17) journalled in a housing (10) and a one-way coupling (18) permits rotation of the second shaft (17) either independently of the first shaft (16) or as a result of rotation of the first shaft (16). A lever (19) fixed to the second shaft (17) may be moved between first and second limit positions by moving a lever (24) on the first shaft (16) or may be moved between the first limit position and an intermediate position by moving a third lever (28-29) which is mounted on a third shaft (27).

16 Claims, 8 Drawing Figures

12a
12
I
10
19
34
20
22
25
17
22a
11
15
17a
21a
26
29b
23
21
31
27c
29a
30
29
27
15a
29c
33
32
13
I
13a

GOVERNOR AND DECELERATOR CONTROL LINKAGE

CROSS REFERENCE TO RELATED APPLICATION

This application is a continuation-in-part of copending application Ser. No. 30,245, filed Feb. 12, 1979 now abandoned.

TECHNICAL FIELD

This invention relates to a manually operated control mechanism of the type in which a first actuator may be used to preposition a control arm at a desired setting while a second actuator may temporarily reposition the control arm at a different setting without disturbing the setting of the first actuator.

BACKGROUND ART

This invention constitutes an improvement upon the apparatus of U.S. Pat. No. 4,052,910, issued Oct. 11, 1977, to applicant's assignee.

The mechanism of U.S. Pat. No. 4,052,910 is entirely satisfactory for its intended purpose, but presents adjustment problems due to the fact that it has an adjustable link 52 to the machine control and a second adjustable link 18 between the control lever 12 and the lever 20. This requires that after the structure is mounted on a vehicle both the link 52 and the link 18 must be adjusted to coordinate the positions of the control lever 12, the lever 20 fixed to the shaft 22, the lever 49 fixed to the shaft 30, and the foot pedal 62 journalled upon the housing 24.

DISCLOSURE OF INVENTION

The present invention is directed to overcoming one or more of the problems as set forth above.

According to the present invention, an engine control linkage comprises a housing, a first shaft journalled in the housing, a second shaft journalled in the housing, one-way coupling means for selectively rotating the second shaft either independently of and without affecting the first shaft, or as a result of rotation of the first shaft. A first lever is mounted on the second shaft, means is operatively connected to the first shaft to move the second shaft between first and second limit positions. A third shaft is journalled in the housing, and means is operatively associated with the third shaft to rotate the second shaft and the first lever, independently of the first shaft and without disturbing the latter, between said first limit position and a third position which is intermediate the first and second limit positions.

BEST MODE FOR CARRYING OUT THE INVENTION

Figure 1:
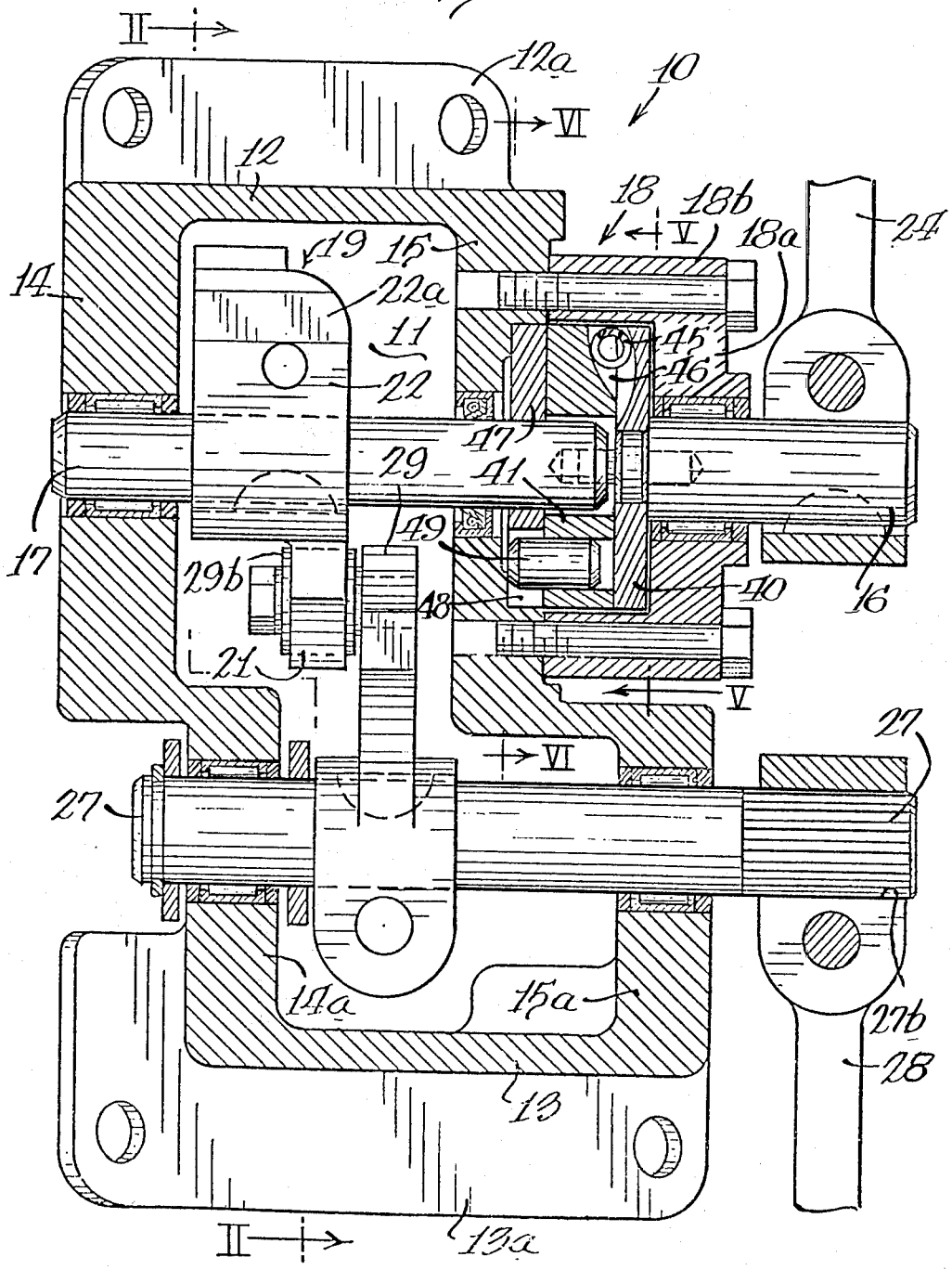
FIG. 1 is a sectional view of the apparatus of the invention taken substantially as indicated along the line I—I of FIG. 2.
Figure 2:
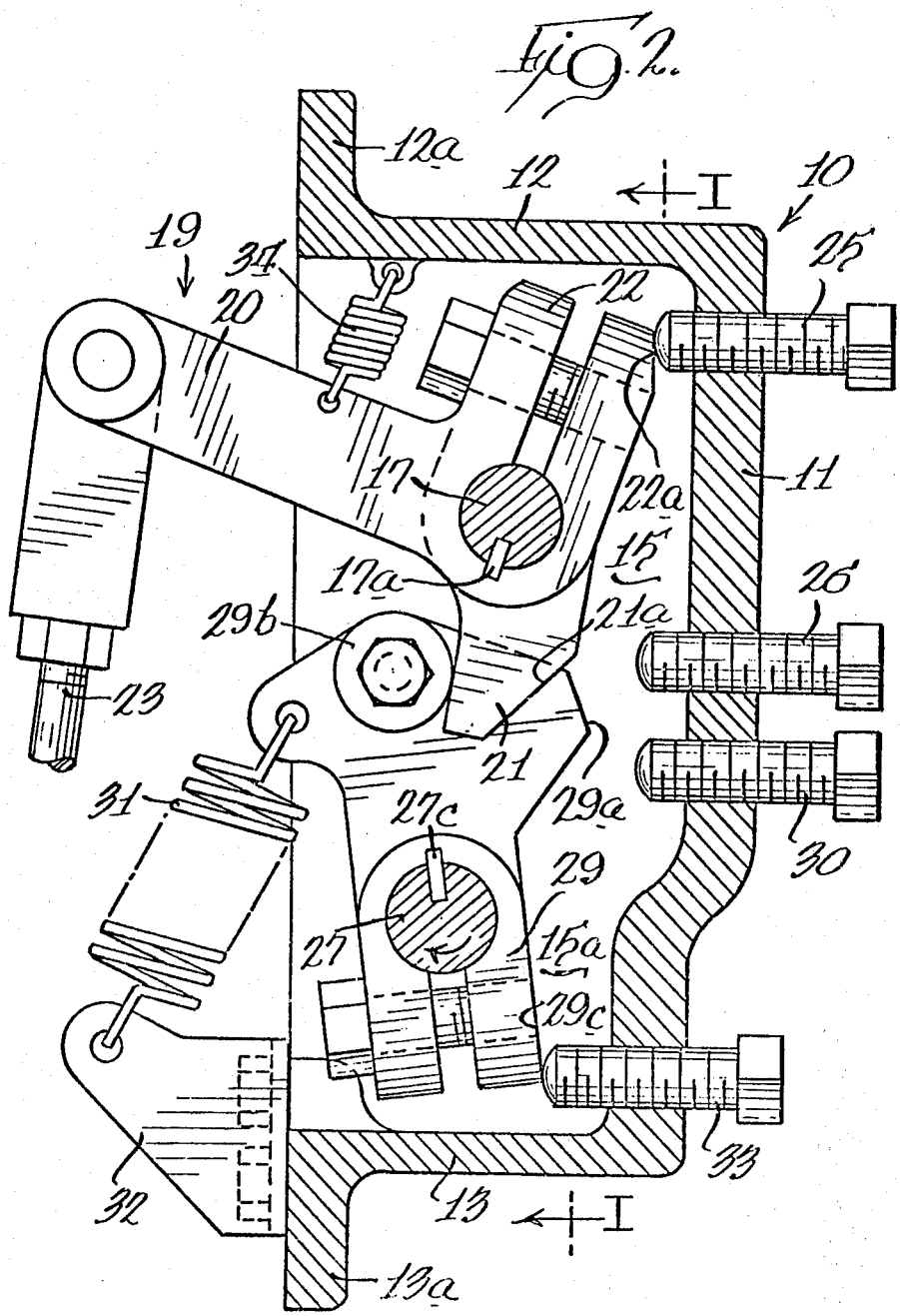
FIG. 2 is a sectional view taken substantially as indicated along the line II—II of FIG. 1, with the mechanism in its "high idle" position.
Figure 3:
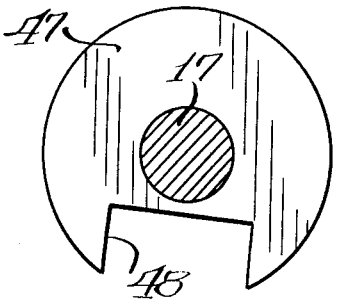
FIG. 3 is an elevational view of a notch plate of the one-way coupling which is at the left side of the coupling as viewed in FIG. 1.
Figure 4:
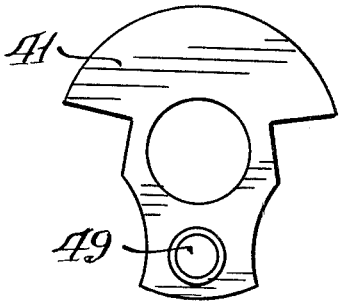
FIG. 4 is an elevational view of a locking plate of the one-way coupling which is immediately to the right of the notch plate as viewed in FIG. 1.
Figure 5:
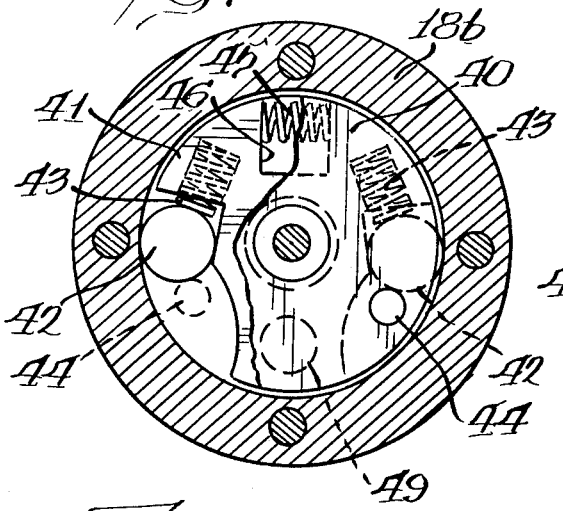
FIG. 5 is a sectional view, partly broken away, along the line V—V of FIG. 2.

Referring to FIGS. 1 and 2 of the drawings, a housing, indicated generally at, 10, includes a back wall 11 which has a top web 12 and a bottom web 13 at substantially right angles thereto; and said webs terminate in respective mounting brackets 12*a* and 13*a* which are in a plane parallel to the back wall 11, and the housing also includes side walls 14 and 15. A first shaft 16 and a second shaft 17 are journalled in axial alignment with one another in said side walls and on a mounting plate 18*a* of a one-way coupling, indicated generally at 18, which has an annular wall 18*b* defining a cavity. The one-way coupling provides means for selectively rotating the second shaft 17 either independently of and without affecting the first shaft 16, or as a result of rotation of the first shaft 16. Details of the one-way coupling are set out hereinafter.

Clamped onto the second shaft 17 and fixed by a key 17*a* is a first lever, indicated generally at 19, which includes a linkage arm 20, a contact arm 21 substantially at right angles to the linkage arm, and a limit arm 22 which extends from the shaft 17 substantially diametrically opposite the contact arm 21. A control link 23 connects the linkage arm 20 to a machine control (not shown).

Connected to the first shaft 16 is an operating means 24 which, in the particular application of the apparatus here disclosed, constitutes a manual control lever which is fixedly secured to the shaft 16.

An operator can use the control lever 24 to move the first lever 19 between a first limit position and a second limit position. The first limit position of the lever 19 is fixed by an adjustable stop means 25 which is abutted by a surface 22*a* on the limit arm 22 of the lever 19; while the second limit position is fixed by stop means 26 which is abutted by a face 21*a* on the contact arm 21 of the first lever 19. Both the first and second stop means 25 and 26 are bolts which extend through threaded bores in the housing wall 11, so that the two limit positions can readily be established by adjustment of the two stop means.

Extensions 14*a* and 15*a* of the housing walls 14 and 15 provide support for a third shaft 27 which is journalled in said walls parallel to the coaxial shafts 16 and 17. A lever arm 28 is fixedly mounted upon an end portion 27*a* of the third shaft 27 by a splined connection 27*b*; and fixed to the shaft 27 by a key 27*c*, in spaced relationship to the lever arm 28, is a second arm 29 which is so located that the first lever arm 28, the shaft 27 and the second arm 29 cooperate to form a bell crank. Movement of the first lever arm 28 to rotate the third shaft 27 clockwise, as indicated by the arrow in FIG. 2, moves the first lever 19 between the first position abutting the first stop means 25 and a third position which is intermediate the first and second limit positions. The third position is established by abutment of a stop surface 29*a* of the second bell crank arm 29 with an adjustable stop means 30 in the form of a bolt which screws through a threaded bore in the housing wall 11. Driving contact between the second arm 29 and the contact arm 21 is through a roller 29*b* on the second arm 29.

The one-way coupling 18 functions so that rotation of the second shaft 17 and the first lever 19 by operation of the lever arm 28 does not affect the position of the first shaft 16 and the control lever 24. As seen in FIGS. 1 and 3 to 8, the one-way coupling 18 constitutes a modification of the one-way coupling of U.S. Pat. No. 4,052,910. The coupling 18 includes a disc 40 fixed to the inner end of shaft 16 so as to rotate therewith; a locking plate 41 rotatable on the shaft 17; wedging members 42 between the locking plate 41 and the side wall 18*b;* compression springs 43 bearing on the wedging members 42; unlocking pins 44 and a damping spring 45 within a recess 46 in abutting faces of the disc 40 and the locking plate 41. As described up to this point, the one-way coupling 18 is identical with that in U.S. Pat. No. 4,052,910, and the components interact in the same way.

In addition, the one-way coupling 18 also has a notch plate 47 which has a peripheral notch 48, and a pin 49 on the locking plate 41 extends into the notch 48.

Figure 6:
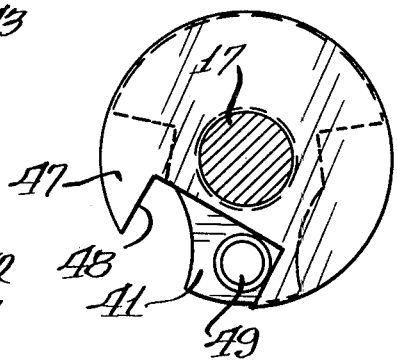
FIGS. 6, 7 and 8 are diagrammatic views along the line VI—VI of FIG. 2, illustrating the relative positions of the notch plate and the locking plate in high idle, low idle, and deceleration positions, respectively.
Figure 7:
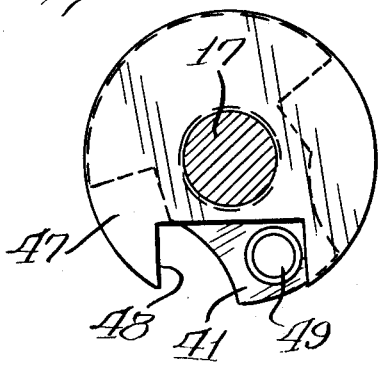
Figure 8:
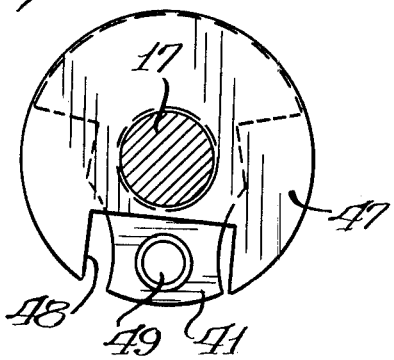

As seen by comparing FIGS. 6 to 8, movement of the lever 24 from the high idle position seen in FIGS. 2 and 6 to the low idle position of FIG. 7 turns the notch plate 47 by impingement of the pin 49 with one side of notch 48; and this rotates the shaft 17 counterclockwise as seen in FIG. 2 to move the control link 23 downward. When the one-way coupling parts are in the high idle position of FIG. 6, depressing the pedal 28 rotates the idler control linkage and the notch plate 47 toward the low idle position without affecting the position of the locking plate 41, as seen in FIG. 8.

A tension spring 31 connected to the second arm 29, and to a spring anchor bracket 32, biases the second arm, and thus also the first lever arm 28, in a counterclockwise direction, as seen in FIG. 2, to normally abut the stop surface 29*c* of the second arm 29 against an adjustable stop means 33 in the form of a bolt which screws through a threaded bore in the housing wall 11.

A second tension spring 34 is secured to the linkage arm 20 of the first lever 19 and to an appropriately positioned spring anchoring hole on the housing top web 12 so as to urge the first lever 19 to the position in which the surface 22*a* of the limit arm 22 abuts the adjustable stop bolt 25.

It can be seen from the foregoing description that adjustment of the four stop bolts 25, 26, 30 and 33 coordinates the first and second limit positions, the third position, and the normal position of the second arm 29 of the bell crank.

INDUSTRIAL APPLICABILITY

A typical application of the improved control mechanism of the present invention is in the adjustment and utilization of the governor of a high powered diesel engine as used in heavy equipment such, for example, as earthmover, bulldozers, and other comparable devices. In that case the control link 23 connected to the linkage arm 20 controls the engine governor, the first limit position, established by the first stop bolt 25, is the high idle position of the governor which sets the normal operating speed of the diesel engine; the second limit position, established by the second stop bolt 26, is the low idle position; while the third position, established by abutment of the surface 29*c* with the stop bolt 30, is the minimum engine operating level attainable by use of the pedal 28.

In use, the operator moves the lever 24 (away from the viewer as seen in FIG. 1) to set the governor control mechanism to a desired idling speed at which the engine is to operate in service. Usually this will be the high idle position of FIG. 2. If it becomes necessary to reduce engine speed the operator presses the pedal 28 which acts through the shaft 27, the arm 29, and the roller 29*b*, to rotate the shaft 17 counterclockwise and thus move the control link 23. As seen in FIG. 8, such rotation of the shaft 17 moves the one-way coupling notch plate 47 from the position of FIG. 6 toward the position of FIG. 7 without moving the one-way coupling locking plate 41. When pressure on the pedal 28 is released the springs 31 and 34 return the mechanism to the position of FIG. 2.

To lower the maximum operating speed, the operator moves the handle 24 toward the viewer as seen in FIG. 1; and this acts through the locking plate 41 and the notch plate 47 to rotate the shaft 17 counter-clockwise as seen in FIG. 2 and thus move the surface 21*a* toward the stop screw 26 which determines the minimum idling speed.

For reasons stated in U.S. Pat. No. 4,052,910, the governor will lock at any position between low idle and high idle to which the operator adjusts it.

The present control mechanism may be completely assembled and adjusted in the shop, and bench tested, so that if necessary it may be field mounted in a piece of heavy equipment with no installation adjustment except for the length of the control link 23.

Other aspects, objects and advantages of this invention can be obtained from a study of the drawings, the disclosure and the appended claims. The foregoing detailed description has been given for clearness of understanding only and no unnecessary limitations should be understood therefrom as modifications will be obvious to those skilled in the art.

I claim:

1. In an engine control linkage which comprises a housing (10), a first shaft (16) journalled in the housing, a second shaft (17) journalled in the housing, and one-way coupling means (18) for selectively rotating the second shaft (17) either independently of and without affecting the first shaft (16), or as a result of rotating the first shaft (16), the improvement comprising:

a first lever (19) mounted on the second shaft (17);

means (24) operatively connected to the first shaft (16) for rotating said first shaft to move the second shaft (17) and said first lever (19) between first and second limit positions of said first lever (19);

a third shaft (27) journalled in the housing (10);

and means (28–29) operatively associated with said third shaft (27) to rotate the second shaft (17) and the first lever (19) independently of the first shaft (16), and without disturbing the latter, between said first limit position and a third position which is intermediate said first and second limit positions.

2. The improvement of claim 1 which includes first stop means (25) on the housing (10) fixing said first limit position, second stop means (26) on the housing fixing said second limit position, third stop means (30) on the housing (10) fixing said third position, spaced surfaces (22*a*–21*a*) on the first lever (19), each of which contacts one of said first (25) and second (26) stop means at said respective limit positions, and said means (29) operatively associated with the third shaft (27) having a surface (29*a*) which contacts said third stop means (30).

3. The improvement of claim 2 which includes resilient means (34) urging the first lever (19) against the first stop means (25).

4. The improvement of claim 3 which includes means (31) biasing said arm means (29) on the third shaft (27) away from said first lever (19).

5. The improvement of claim 4 which includes a fourth stop means (33) limiting the rotation of said third shaft (27), and the means operatively associated therewith, responsive to said biasing means (31).

6. The improvement of claim 5 in which all four stops (25,26,30,33) are adjustable.

7. The improvement of claim 1 in which the means (24) operatively connected to the first shaft (16) comprises a second lever.

8. The improvement of claim 1 in which the means (28–29) operatively associated with the third shaft (27) comprises a bell crank lever having a first actuating arm (28) and a second arm (29) which acts on the first lever (19) for rotating said first lever (19) and second shaft (17).

9. The improvement of claim 8 in which the first lever (19) has a linkage arm (20), a contact arm (21) substantially at right angles to said linkage arm (19) which is contacted by the second arm (29) of the bell crank, and a motor control link (23) is operatively connected to said linkage arm (20).

10. The improvement of claim 9 which includes first stop means (25) on the housing (10) fixing said first limit position, second stop means (26) on the housing (10) fixing said second limit position, third stop means (30) on the housing (10) fixing said third position, a surface (21*a*) on said contact arm (21) of the first lever (19) which contacts the second stop means (26), a limit arm (22) on said first lever (19) which contacts the first stop means (25), and a surface on the second arm (29) of the bell crank lever which contacts the third stop means (30).

11. The improvement of claim 10 which includes resilient means (34) urging the limit arm (22) of the first lever (19) against the first stop means (25), means (31) biasing the bell crank (28–29) in a direction tending to separate the second arm (29) of the bell crank from the contact arm (21) of the first lever, and a fourth stop (34) on the housing (10) which is adjustable and limits the rotation of said bell crank (28–29) responsive to said biasing means (31).

12. The improvement of claim 11 in which the first (25), second (26) and third (30) stops are adjustable.

13. The improvement of claim 8 which includes a roller (29*b*) on the second arm (29) of the bell crank which abuts the first lever (19).

14. In an engine control linkage which comprises a housing (10), a first shaft (16) journalled in the housing, a second shaft (17) journalled in the housing, one-way coupling means (18) for selectively rotating the second shaft (17) either independently of and without affecting the first shaft (16) or as a result of rotating the first shaft (16), a first lever (19) mounted on the second shaft (17), an engine control linkage (23) operatively connected to said first lever (19), a second lever (24) fixed to the first shaft (16) for rotating said two shafts (16–17) to move said engine control linkage (23), and a third lever (28–29) to rotate the second shaft (17) for moving the engine control linkage (23) independently of the first shaft (16) and said second lever (24), the improvement comprising:

means (17*a*) fixedly securing the first lever (19) to the second shaft (17);

a direct operative connection between said first lever (19) and said engine control linkage (23);

first stop means (25) on the housing (10);

means (34) urging the first lever (19) against said first stop means (25) to fix the engine control (23) in a predetermined position;

a third shaft (27) journalled in the housing (10);

means (27*b* and 27*c*) fixedly mounting the third lever (28–29) on the third shaft (27);

abutting arms (29 and 21) on the third lever (28–29) and on the first lever (19) so arranged that movement of said third lever (28–29) in a first direction rotates the first lever (19) away from said first stop means (25);

means (31) biasing the third lever (28–29) in a direction opposite to said first direction;

and another stop means (30) on the housing (10) limiting movement of the third lever (28–29) in said first direction.

15. The improvement of claim 14 which includes second stop means (26) on the housing (10) which limits movement of the first lever (19) away from said first stop means (25) only when the second shaft (17) is rotated by the first shaft (16).

16. The improvement of claim 14 which includes fourth stop means (33) on the housing (10) to limit movement of the third lever (28–29) by said biasing means (31).

* * * * *